United States Patent [19]

Hahn

[11] 4,441,418

[45] Apr. 10, 1984

[54] OVERVARNISH APPARATUS FOR DECORATOR MACHINE

[75] Inventor: Roger A. Hahn, Arvada, Colo.

[73] Assignee: Adolph Coors Company, Golden, Colo.

[21] Appl. No.: 345,321

[22] Filed: Feb. 3, 1982

[51] Int. Cl.[3] ..... B41F 17/08

[52] U.S. Cl. ..... 101/38 R

[58] Field of Search ..... 101/38 R, 38 A, 39, 101/40; 414/737

[56] References Cited

U.S. PATENT DOCUMENTS

| | | | |
|---|---|---|---|
| 3,279,360 | 10/1966 | Smith et al. | 101/40 |
| 3,613,571 | 10/1971 | Russell et al. | 101/40 |
| 3,718,085 | 2/1973 | Perret | 101/40 |
| 4,037,530 | 7/1977 | Sirvet | 101/40 |
| 4,048,917 | 9/1977 | Surypek et al. | 101/40 |
| 4,138,941 | 2/1979 | McMillin et al. | 414/737 X |
| 4,222,479 | 9/1980 | Dugan et al. | 101/40 |
| 4,266,478 | 5/1981 | Ackley | 101/40 |
| 4,267,771 | 5/1981 | Stirbis | 101/40 |

*Primary Examiner*—E. H. Eickholt

*Attorney, Agent, or Firm*—Bruce G. Klaas

[57] ABSTRACT

An overvarnish unit for a can decorator machine mounted on an adjustable frame which supports an adjustable applicator roll for applying a coating material associated with a pre-spin wheel for rotatable mandrels and also supports an adjustable coating material meter roll associated with an adjustable fountain means.

11 Claims, 19 Drawing Figures

OVERVARNISH APPARATUS FOR DECORATOR MACHINE

BACKGROUND & SUMMARY OF INVENTION

This invention relates to overcoat apparatus associated with a can decorating machine.

At the present time, one-piece can body members are conventionally decorated with ink images on relatively high speed can decorator machines operating at speeds of 1000 or more cans per minute. It is often desirable to apply a lacquer overcoat after the can body has been decorated. In the past, lacquer overcoats have been applied by separate coating machines and by coating apparatus mounted on the decorator machine. A major problem in application of lacquer overcoats is controlling and maintaining the amount and uniformity of application of the lacquer to the can body over wet ink images thereon so as to avoid smearing of the ink images and enabling subsequent curing in conventional oven curing systems. It will be apparent that a can manufacturer having a can manufacturing line capable of producing millions of cans per day and billions of cans per year cannot tolerate loss of production for any significant period of time. If the decorating and/or coating and/or curing system fail to operate properly, there can be tremendous production losses resulting from down time time on the line or scrapping of poorly decorated cans.

In general, the present invention comprises apparatus for decorating cans or the like having: a mandrel wheel means having a plurality of circumferentially spaced rotatable mandrel means for carrying cans in a generally circular path of movement past inking means for applying ink images to the peripheral surfaces of the cans; an applicator roll means located next adjacent and downstream of said inking means and being engageable with the peripheral surfaces of the cans for applying a coating over the ink images on the peripheral surfaces of the cans; a pre-spin wheel means operatively associated with said applicator roll means and being engageable with said rotatable mandrel means before said applicator roll means engages the peripheral surfaces of the cans for causing rotation of said rotatable mandrel means prior to engagement of said applicator roll means with the peripheral surfaces of the cans; a single engraved meter roll means mounted in juxtaposition to and engaging said applicator roll means for applying predetermined solvents of coating material to said applicator roll means; a fountain means having a reservoir for holding a quantity of the coating material and metering blade means operably associated with said meter roll means for applying a predetermined quantity of coating material to said meter roll means; drive means operably connected to said mandrel wheel means and said applicator roll means and said pre-spin wheel means and said meter roll means for causing synchronized rotation thereof; a common movable support means for supporting said applicator roll means and said pre-spin wheel means and said meter roll means and said fountain means for movement between an operational position adjacent said mandrel wheel means whereat said applicator roll means engages the peripheral surfaces of the cans and an inoperative position whereat said applicator roll means is spaced from the peripheral surfaces of the cans; actuating means operably associated with said common movable support means for selectively moving said common movable support means between the operative position and the inoperative position; an applicator roll pressure adjustment means operably associated with said common movable support means for causing variable movement thereof in the operative position whereby the position and engaging pressure of said applicator roll means relative to the cans is selectively variably adjustable; a meter roll pressure adjustment means mounted on said common movable support means and being operably associated with said meter roll means for selectively variably adjusting the position and engaging pressure of said meter roll means with said applicator roll means; fountain adjustment means mounted on said common movable support means and being operably associated with said fountain means for selectively variably adjusting the position of said fountain means relative to said meter roll means to control the amount and distribution of coating material transferred from said fountain means to said meter roll means; and support adjustment means operatively associated with said common movable support means for selectively variably adjusting the axis of rotation of said applicator roll means relative to the axis of rotation of said mandrel means to maintain substantial parallelism therebetween.

BRIEF DESCRIPTION OF DRAWING

An illustrative and preferred embodiment of the invention is illustrated in the accompanying drawing in which.

DETAILED DESCRIPTION

Figure 1:
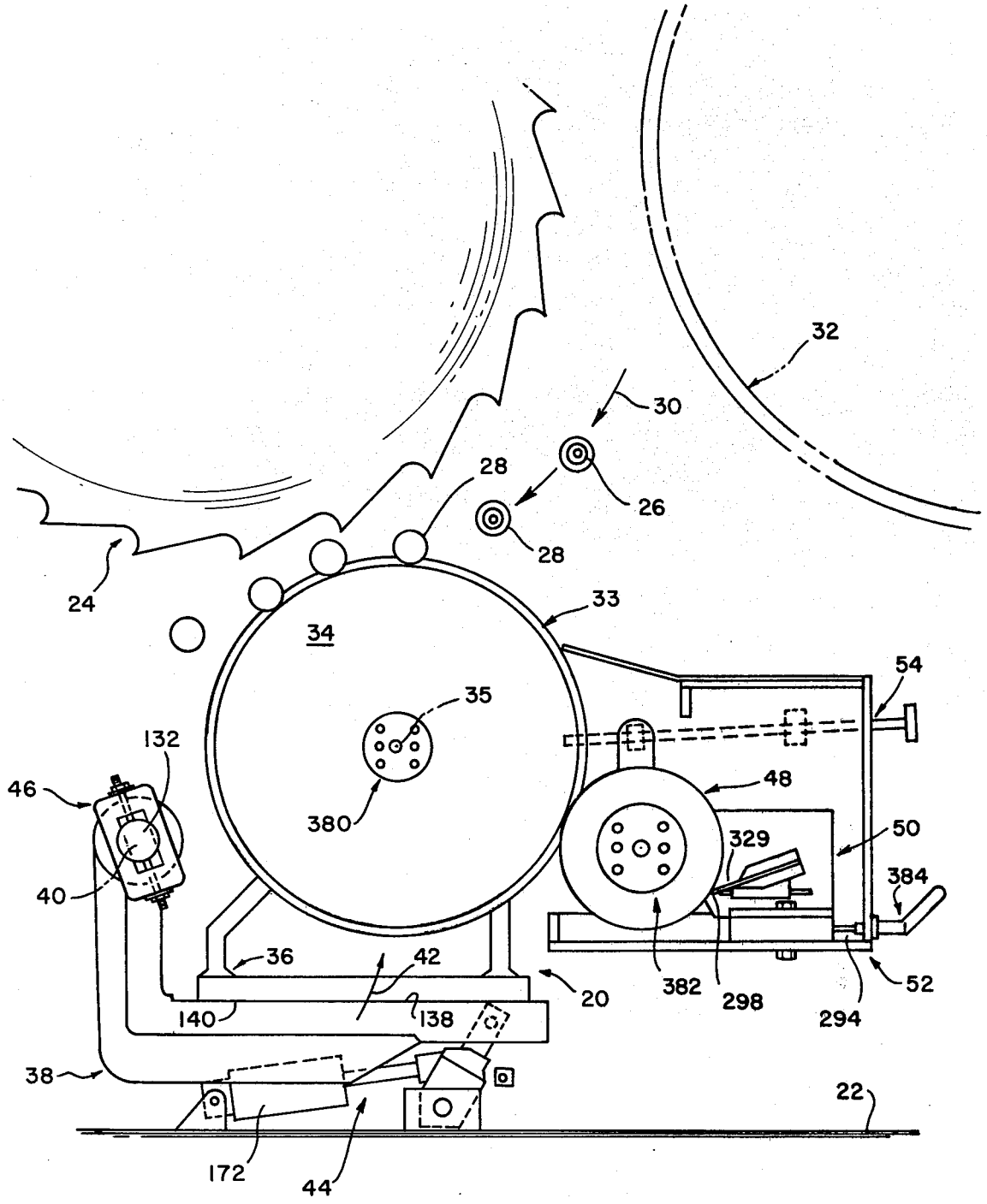
FIG. 1 is a schematic side elevational view, with parts removed, of a portion of the apparatus of the present invention as associated with a can decorator machine.
Figure 2:
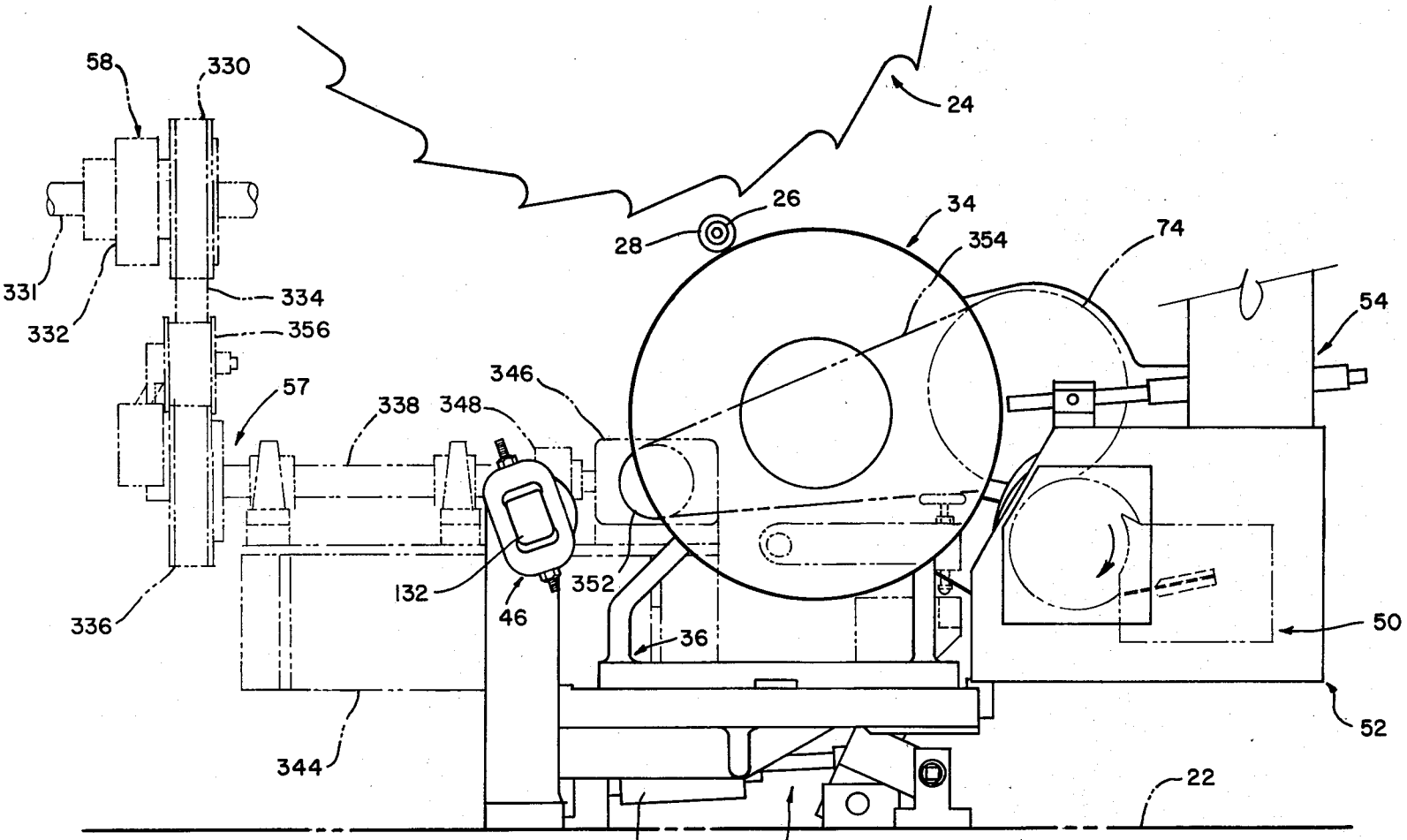
FIG. 2 is a side elevational view of the apparatus of FIG. 1.
Figure 3:
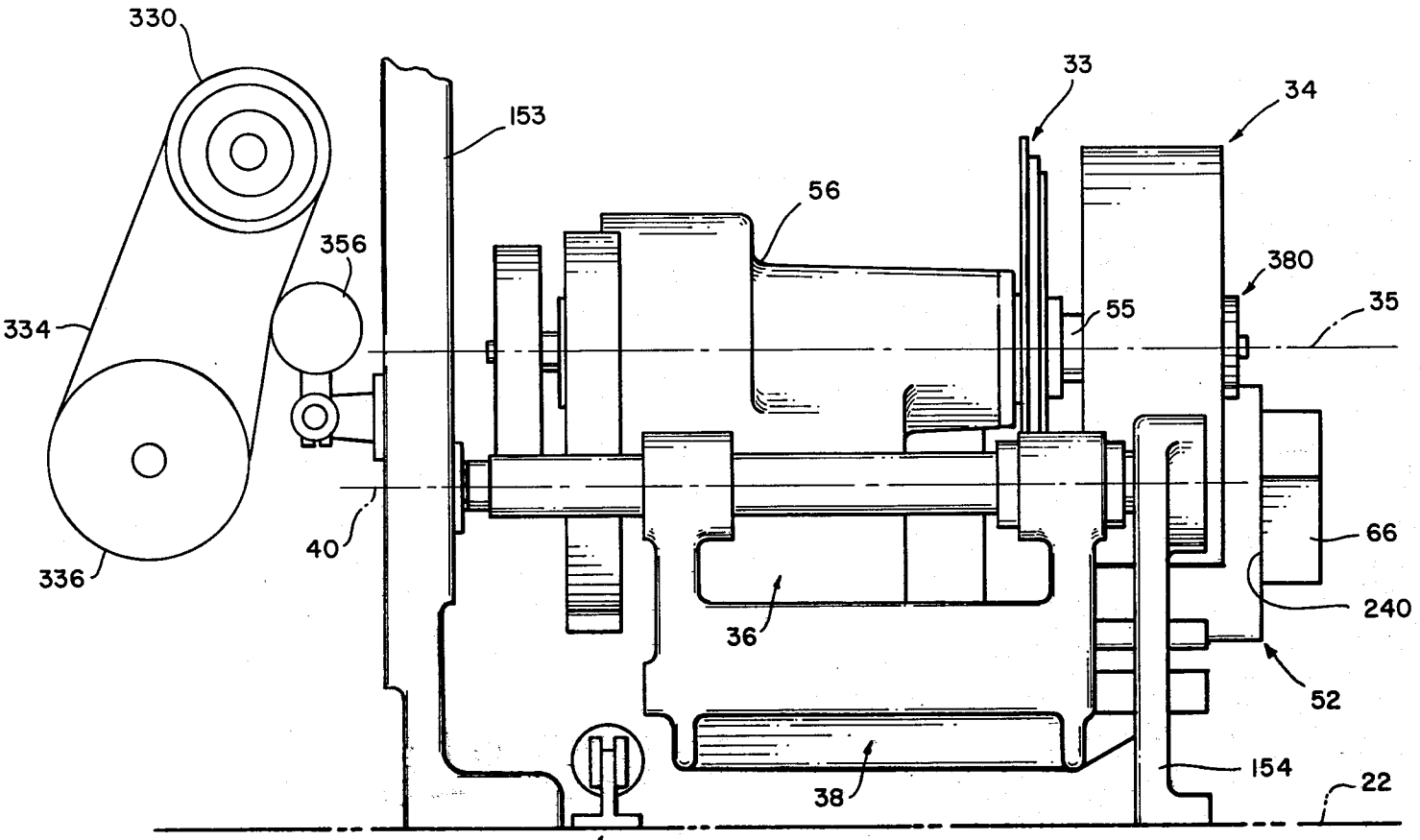
FIG. 3 is an end view, with parts removed, of the apparatus of FIG. 2.

In general, as shown in FIGS. 1–3, the overvarnish apparatus 20 of the present invention is mounted on a support frame means 22 beneath and to one side of a mandrel wheel means 24 of a conventional can decorator machine of the type described in U.S. Pat. Nos. 4,037,530, 4,138,941, 4,222,479 and 4,267,771. The mandrel wheel means 24 includes a plurality of circumferentially spaced rotatable mandrel means 26 which receive and carry can body members 28 in a generally circular path indicated by arrow 30 past ink image applying blanket apparatus 32 whereat ink label images are applied to the peripheral surfaces of the cans. After the cans have been decorated, they are carried past the overvarnish apparatus 20 whereat the mandrel means 26 are engaged by a pre-spin wheel means 33 to cause rotation of the mandrels before a protective coating of lacquer is applied to the cans by a relatively large applicator roll means 34 parallel with the axes of the mandrel wheel means which is rotatable about axis 35. The pre-spin wheel means 33 and applicator roll means 34 are mounted on a movable frame means 36 which is adjustably supported by a pivot arm means 38 for enabling adjustment of the peripheral location of roll means 34 relative to mandrel wheel means 26 about a pivotal axis 40 in the directions of arrow 42 by actuation of a power operated adjustment means 44. An adjustment means 46 is associated with arm means 38 to enable the applicator roll axis 35 to be adjusted into parallel relationship with the longitudinal axes of mandrel means 26. A relatively small diameter engraved lacquer metering roll means 48 is mounted on frame means 36 for applying lacquer to applicator roll means 34 from a fountain means 50 mounted in a fountain housing means 52. An adjustment means 54 is mounted on frame means 36 and operatively associated with meter roll means 48 and housing means 52 to enable adjustment of the position of the meter roll means relative to applicator roll means 34. The pre-spin means 33, applicator roll means 34 and meter roll means 48 are mounted on a shaft 55 in a bearing block 56, FIG. 3, and are operatively connected to drive means 57, FIG. 2, operated by a main drive shaft 58 of the decorator machine.

Figure 4:
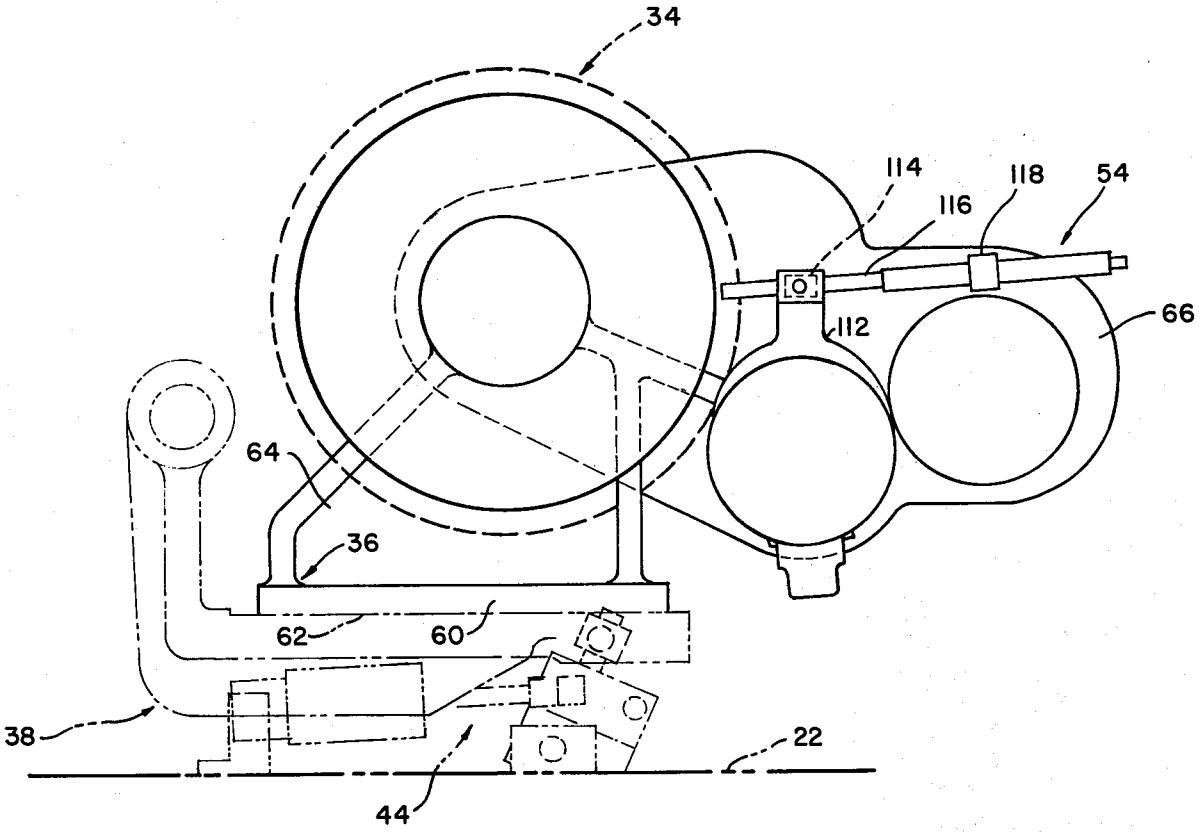
FIG. 4 is a side elevational view of a metering roller-applicator wheel sub-assembly of the apparatus of FIG. 1.
Figure 5:
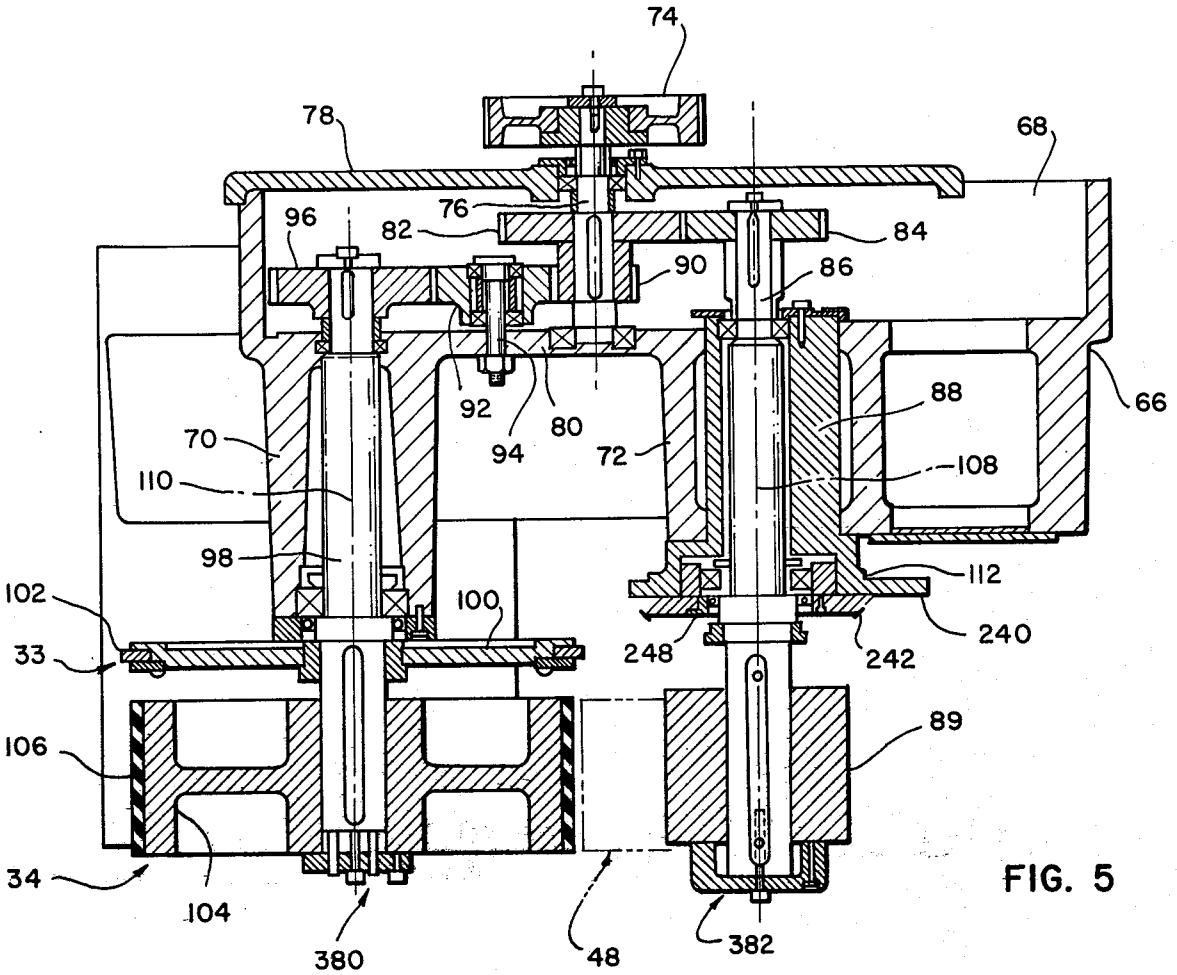
FIG. 5 is a cross-sectional plan view of the sub-assembly of FIG. 4.

Referring now to FIGS. 4 & 5, the frame means 36 is in the form of a rectangular shape casting having a base portion 60 with a flat bottom support surface 62, an upwardly outwardly extending pillar portion 64, and a housing portion 66 with a gear cavity 68, an applicator roller shaft hub portion 70, and a meter roller shaft hub portion 72. An input gear 74 is mounted on a shaft 76, rotatably supported in a cover member 78 and housing wall portion 80 by suitable bearing means. A gear 82 on shaft 76 drives a gear 84 on one end of meter roller shaft 86 which is mounted in an eccentric sleeve means 88 by suitable bearing means with meter roller 48 suitably mounted on the opposite end of shaft 86. In FIG. 5, meter roller 48 is shown in a fully retracted inoperative position by solid lines 89 and the operative position by dotted lines. Another gear 90 on shaft 76 drives a gear 92 on shaft 94 and a gear 96 on one end of applicator roll shaft 98 which is rotatably supported in hub position 70 by suitable bearing means. Pre-spin means 33 comprises a wheel member 100 suitably fixedly mounted on an intermediate portion of shaft 98 with an annular peripheral rubber ring member 102 suitably removably attached thereto. Applicator roll means 34 comprises a wheel member 104 suitably fixedly mounted on the end of shaft 98 with an annular peripheral rubber-like sleeve member 106 affixed to the wheel periphery. Sleeve means 88 is rotatably mounted in hub portion 72 so that the location of the meter roll axis 108 may be changed relative to the applicator roll axis 110. A collar portion 112 of sleeve member 88 is connected to a pivot block 114, FIG. 4, attached to a rod member 116 threadably mounted in a block 118 fixed to housing portion 66 to provide adjustment means 54 for engaging meter roll 48 with applicator roll 34 under varying amounts of force.

Figure 8:
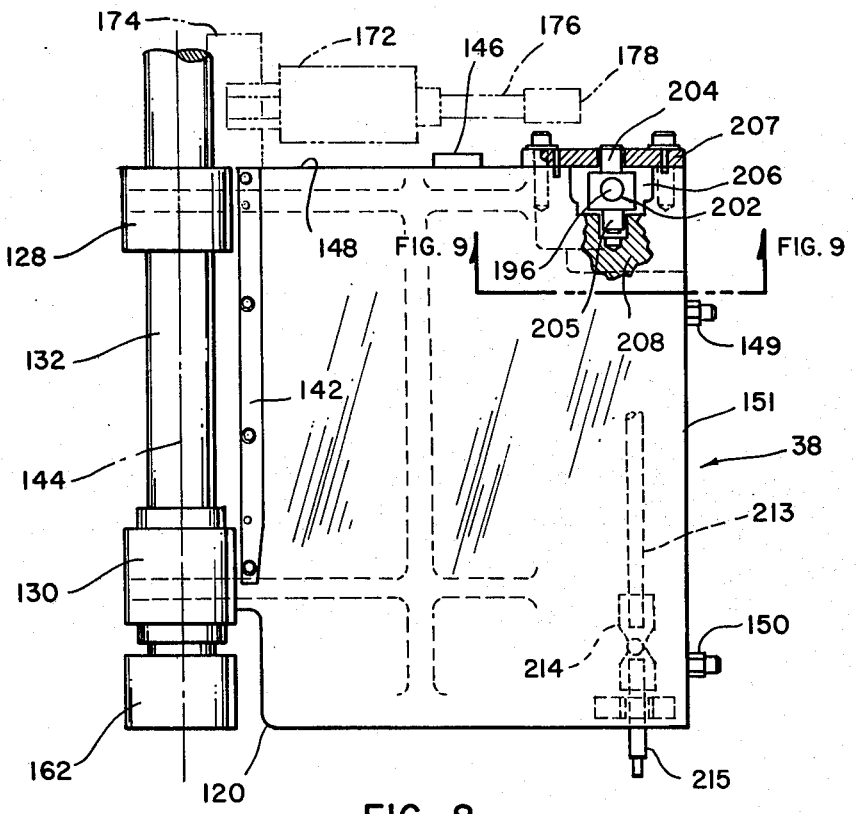
FIG. 8 is a plan view of the apparatus of FIG. 6.
Figure 6:
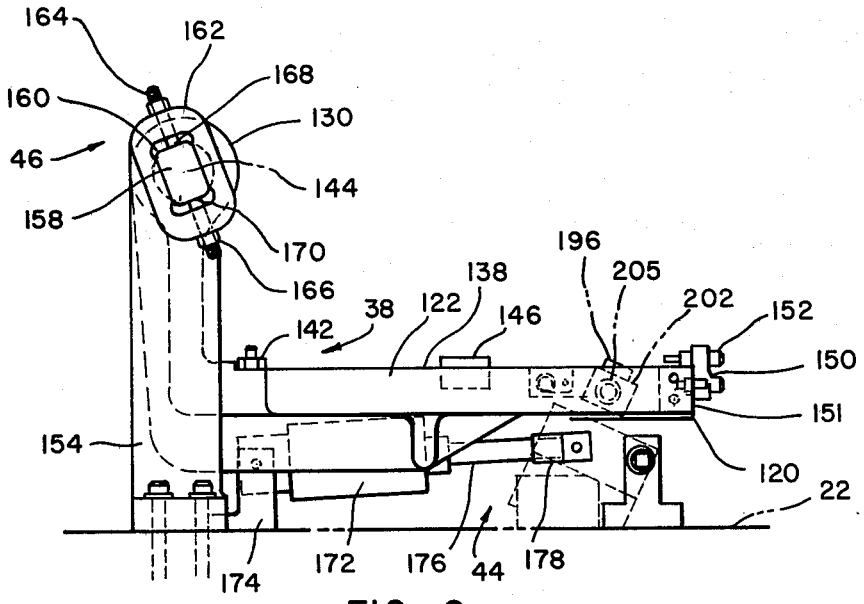
FIG. 6 is a side elevational view of a support base assembly for the sub-assembly of FIG. 4.
Figure 7:
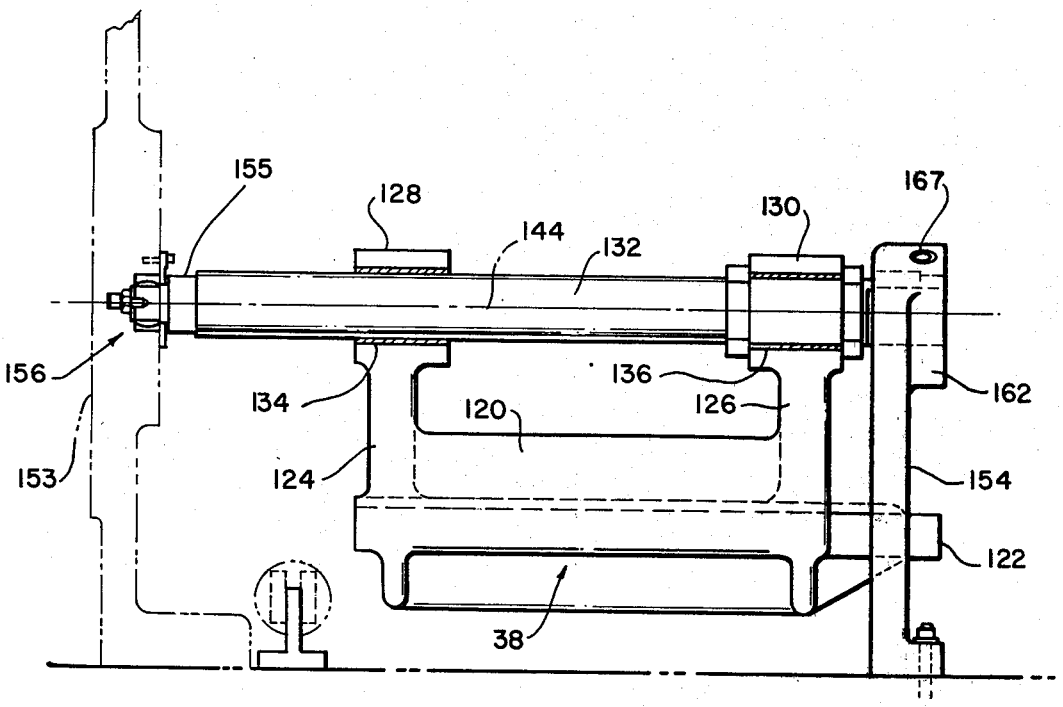
FIG. 7 is an end view of the apparatus of FIG. 6.

Referring now to FIGS. 6–8, the support arm means 38 comprises a cast support arm member 120 having a horizontal base portion 122 and a pair of upwardly extending arm portions 124, 126 terminating in hub portions 128, 130 which receive a shaft number 132 in suitable bearing sleeve devices 134, 136. The upper surface 138 is machined to accurately support the bottom surface 140 of frame means 36, FIG. 1, and a guide bar 142 is accurately mounted by suitable fastening devices along one side parallel to shaft axis 144. A machined stop plate 146 is fixed to one side surface 148. Brackets 149, 150 are fixed to side surface 151 to support jack screw members 152 which hold frame means 36 on support arm means 38. Shaft member 132 is supported between support members 153, 154 fixed on machine frame means 22 with one shaft end portion 155, FIG. 7, mounted in a self-aligning universal type bushing means 156 and the other shaft end portion 158, FIG. 6, mounted in a slot 160 in a hub portion 162 on support member 154. A pair of oppositely mounted swivel screw devices 164, 166, FIG. 6, are threadably lockably mounted on hub portion 162 with end portions 168, 170, FIG. 6, engagable with opposite flat sides of shaft end portion 158 to provide adjustment means 46 whereby the position of shaft 132 relative to support surface 138 may be varied so that applicator roll axis 35 is parallel with the mandrel axes.

Figure 11:
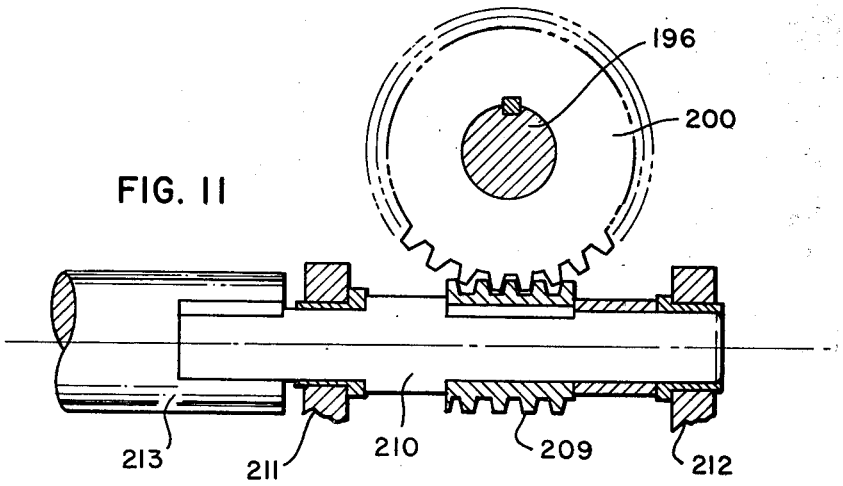
FIG. 11 is another cross-sectional view of the mechanism of FIG. 9.
Figure 10:
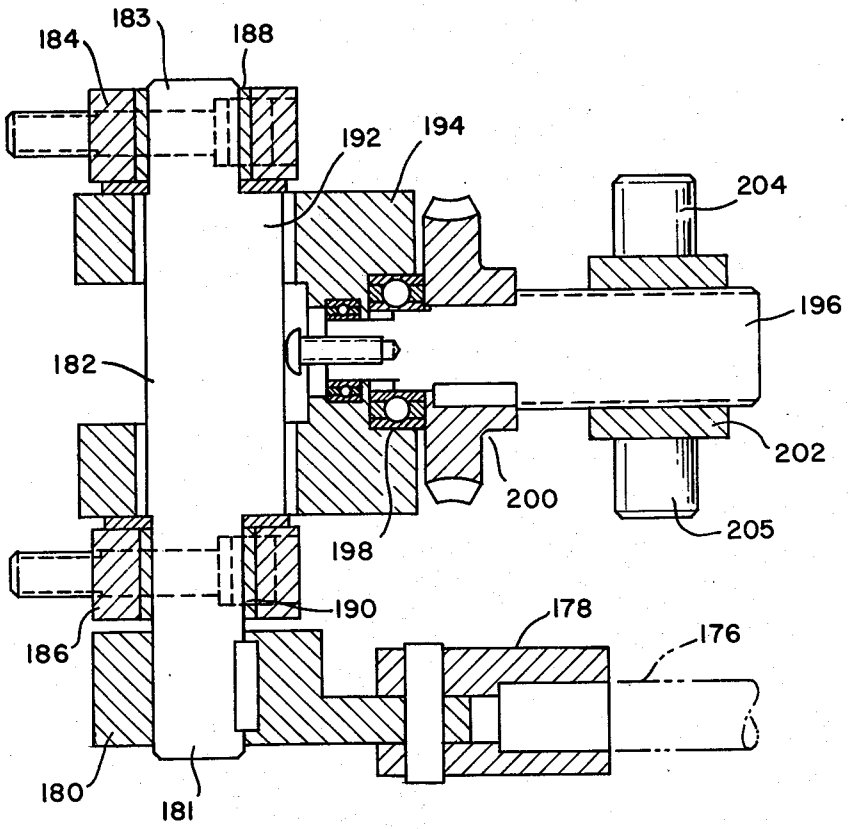
FIG. 10 is a cross-sectional view of the mechanism of FIG. 9.
Figure 9:
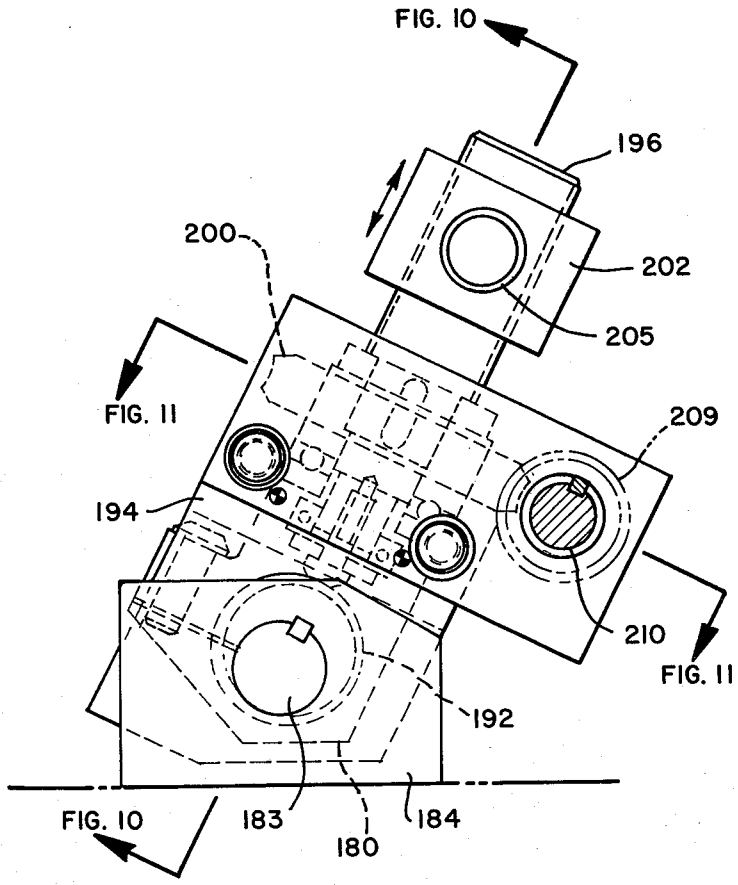
FIG. 9 is an enlarged side view of an adjustment mechanism associated with the apparatus of FIGS. 6–8.

Actuating means 44 comprises an air cylinder 172, FIG. 6, pivotally mounted on a bracket member 174 fixed to machine frame means 22. Cylinder rod 176 is connected to a clevis member 178 pivotally connected to a collar member 180, FIG. 10, eccentrically mounted on a cylindrical end portion 181 of a shaft member 182. Shaft end portions 181, 183 are rotatably supported in bearing blocks 184, 186 by suitable bearing sleeves 188, 190. Shaft 182 has an eccentric center portion 192 mounted in a clevis member 194. A jack screw member 196 is rotatably mounted in clevis member 194 by suitable bearing means 198. A gear member 200 is fixedly mounted on jack screw 196 to cause rotation thereof. A traveling nut member 202 is mounted on jack shaft 196 with opposite pin members 204, 205 pivotally connected to bottom plate portion 120 of support arm means 38 in a cavity 206 between a plate 207 and a casting portion 208 as shown in FIG. 8. Gear 200 is driven by a worm gear 209, FIG. 11, keyed to a connecting shaft 210 which is rotatably mounted between support plates 211, 212. Shaft 210 is keyed to a shaft 213, FIGS. 8 & 11, which extends across the bottom plate portion 120 to a universal coupling member 214 connected to a drive shaft 215 having a coupling 216 for connection to an air wrench or the like (not shown) for manual adjustment. Thus, the arm means 38 may be pivotally moved on shaft 132 by air cylinder 172 between an uppermost position whereat applicator roll 34 is in operative contacting relationship with cans 28 carried by mandrels 26 and a lowermost position whereat applicator roll 34 is in an inoperative non-contact outwardly spaced relationship to the cans. In addition, the position of the applicator roll 34 relative to the mandrels in the uppermost position can be adjusted by manual actuation of jack screw 196 as hereinbefore described.

Figure 14:
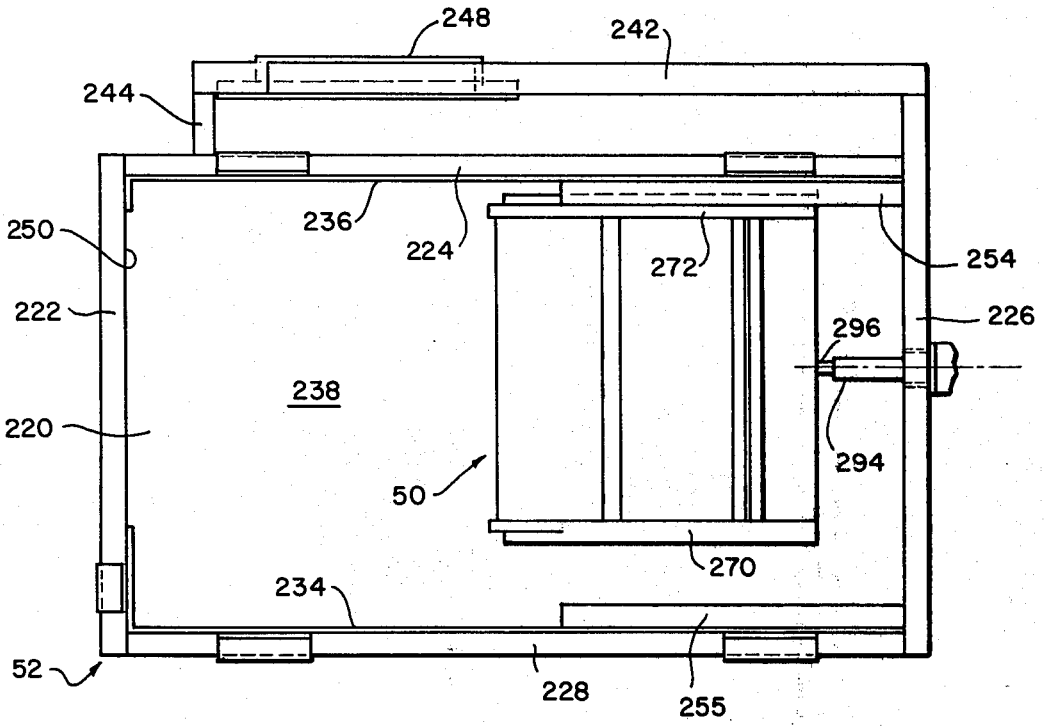
FIG. 14 is a plan view, with parts removed, of the apparatus of FIGS. 12 & 13.
Figure 12:
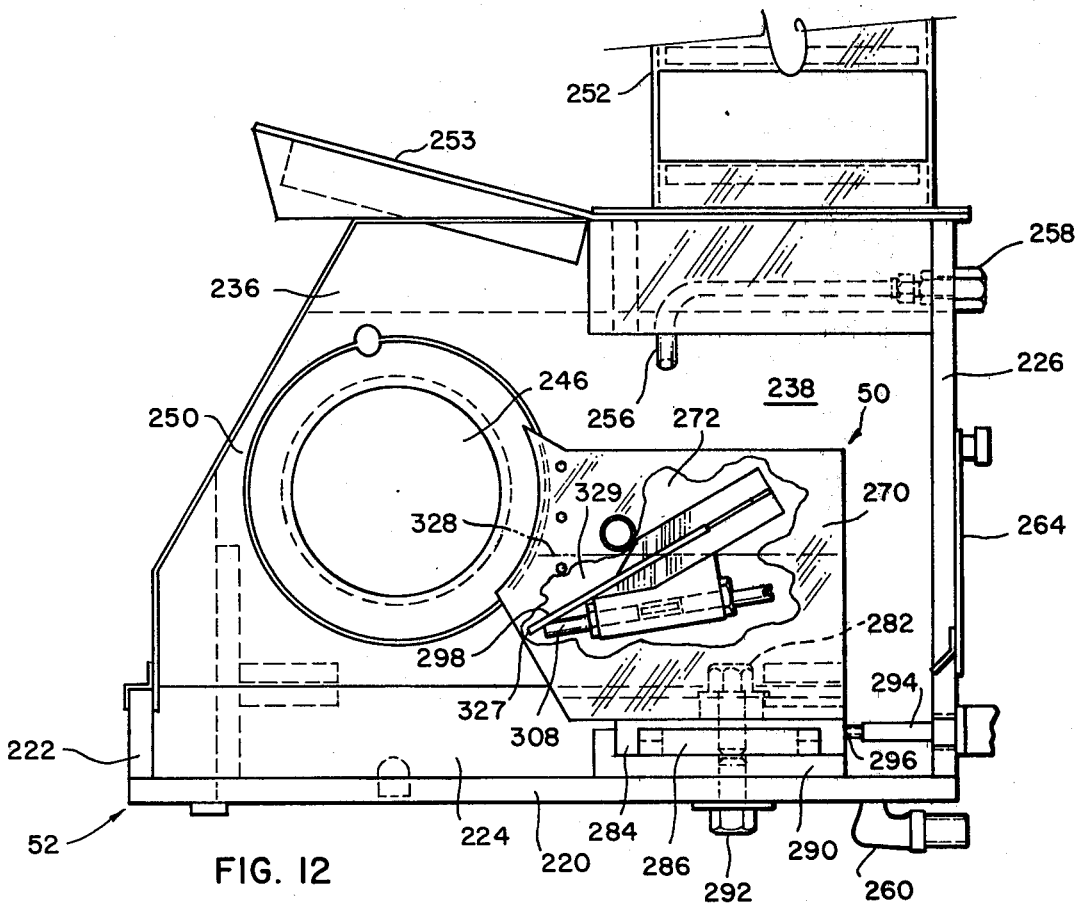
FIG. 12 is a side elevational view, with parts removed, of a fountain sub-assembly for the apparatus of FIG. 1.

Referring now to FIGS. 12–15, the fountain housing means 52 comprises a bottom plate member 220 and side plate members 222, 224, 226, 228, fixed thereto. Sheet metal side walls 234, 236 are mounted on the side plate members to define a chamber 238 in which the fountain means 50 is mounted. Housing means 52 is suitably fixedly attached to side surface 240, FIG. 13, of eccentric sleeve portion 112, FIG. 5, by a mounting plate 242 suitably fixed to an extension of side plate 226 and side plate 224 by a cross plate 244, FIGS. 13 & 14. Circular openings 246, FIG. 12, and 248, FIG. 14, are provided in side wall 236 and mounting plate 242, respectively, to receive meter roll shaft 86, FIG. 5. An opening 250 is provided between side walls 234, 236 to receive a portion of applicator roll 34 and enable contact with meter roll 48. An exhaust hood 252, FIG. 12, connected to a vacuum source (not shown) and an upwardly inclined spray cover 253 are mounted between side plates 254, 255, FIG. 13. A fountain fill hose 256, FIG. 12, is connected to a coupling 258 in plate 226 to enable connection to a lacquer supply hose. A drain hose 260 is mounted in bottom plate 220 to enable lacquer to be removed from a sump area 262 defined by side plates 222, 224, 226, 228. An access door 264 covers an opening in side wall 226 to enable access to fountain means 50.

Figure 13:
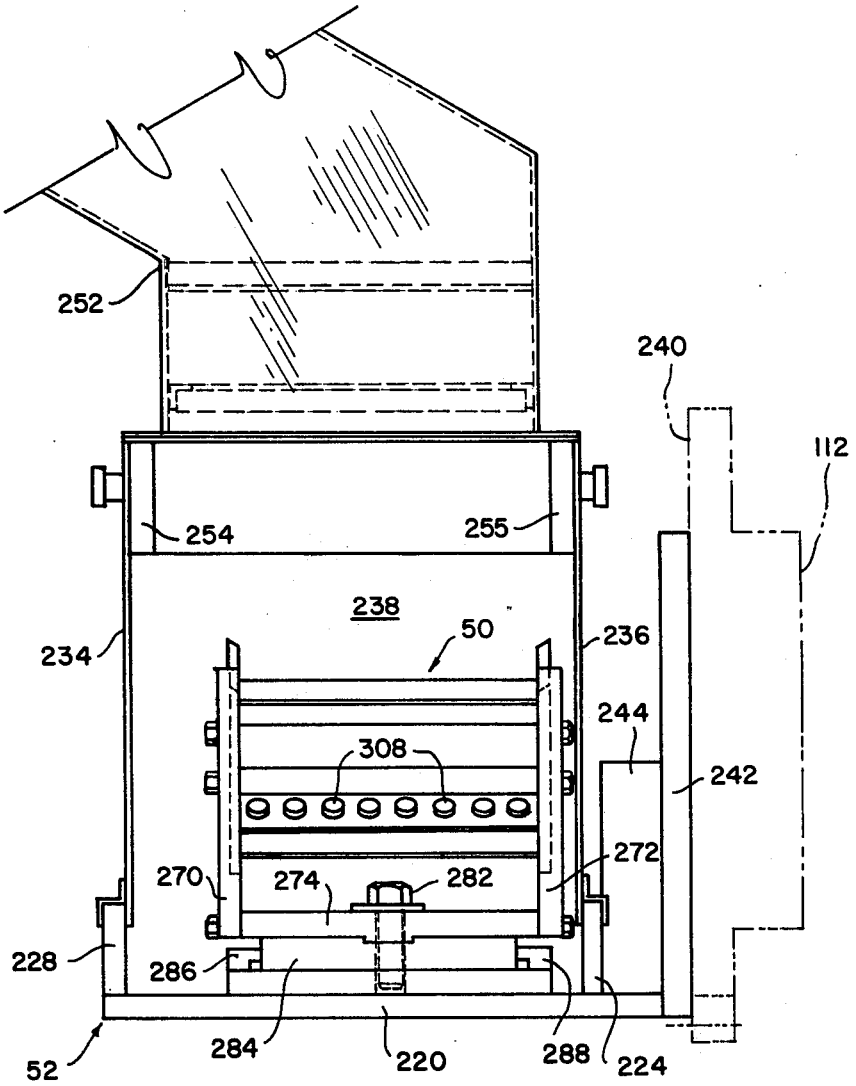
FIG. 13 is an end view of the apparatus of FIG. 12.
Figure 15:
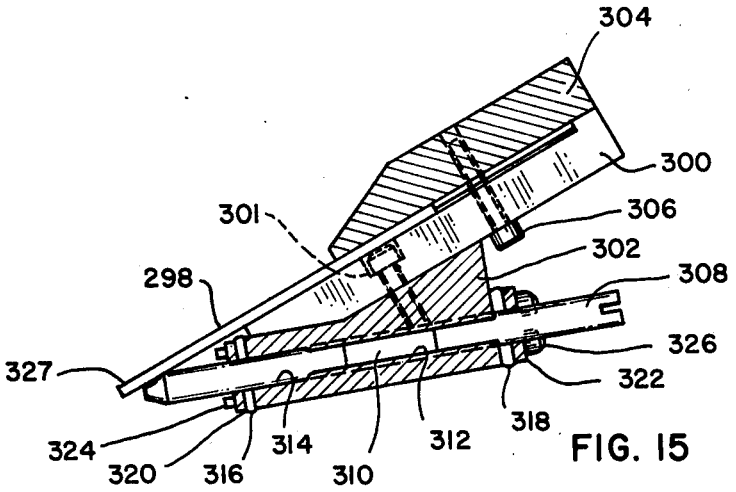
FIG. 15 is an enlarged cross-sectional view of metering blade apparatus of the fountain sub-assembly of FIGS. 12–14.
Figure 16:
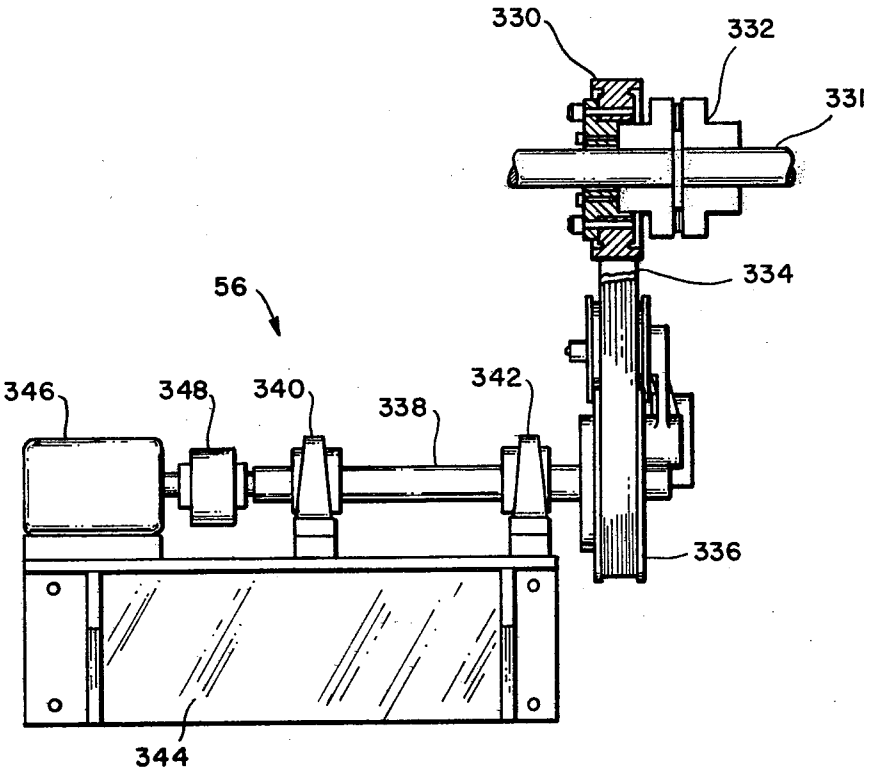
FIG. 16 is a side elevational view of the drive system of the apparatus of FIG. 1.
Figure 19:
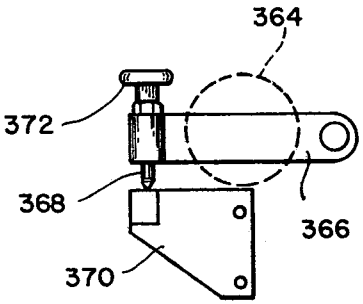
FIG. 19 is a partial view of an adjustment mechanism associated with the drive system of FIGS. 16–18.
Figure 17:
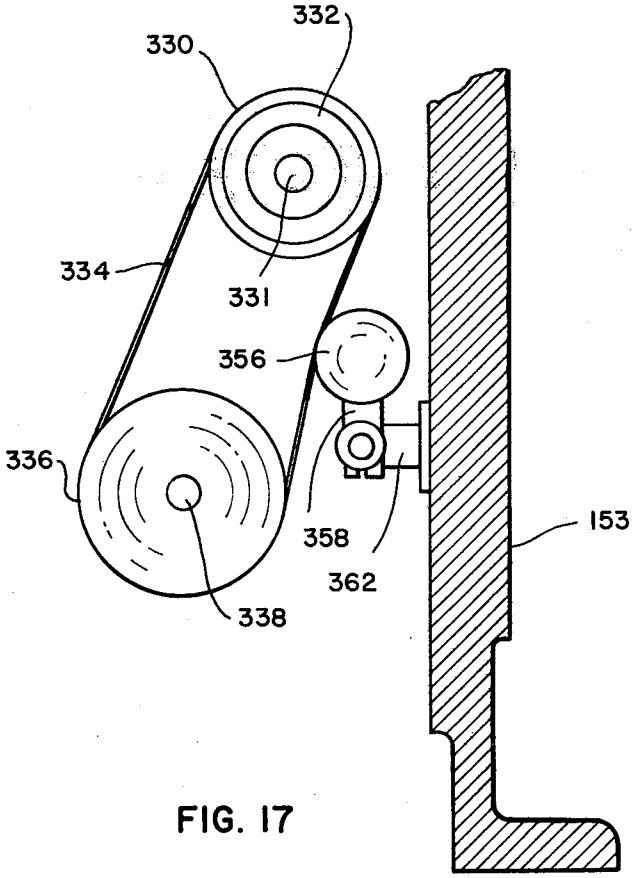
FIG. 17 is an end view of the drive system of FIG. 16.

Fountain means 50 comprises a pair of side plate members 270, 272, FIG. 13, and a bottom plate member 274. The front and rear ends are open. Bottom plate 274 is suitably fixedly attached by bolt means 282 to an adjustably movable slide plate 284 mounted between guide rail members 286, 288 on a support plate 290 suitably adjustably fixedly attached to bottom plate 220 by bolt means 292, FIG. 12. An adjustment screw means 294 is mounted in end plate 226 and presses against support plate 284 at 296 to enable the fountain means to be clamped in place relative to the meter roll 48. A plurality of meter blade members 298, FIG. 15, are mounted on a support block 300 adjustably fixedly secured by bolt means 301 to a mounting block 302 fixedly mounted on and extending between side plates 270, 272. Upper end portions of blade members 298 are adjustably fixedly secured to support block 300 by a block member 304 and adjustment screw means 306. Each of the lower end blade portions engage a separate elongated adjustment screw member 308 having a threaded central portion 310 mounted in a threaded portion 312 of a bore 314. Each end of the bores 314 is sealed by gasket members 316, 318 secured by plate members 320, 322 and bolt means 324, 326. With meter roll means 48 in juxtaposition to the lower end portions 327 of blade members 298, which are mounted in side by side abutting relationship between side plate members 270, 272, a quantity of lacquer is maintained at a level indicated by line 328, FIG. 12, in a lacquer reservoir 329 therebetween. Apparatus of this type is more fully described in copending U.S. Patent application Ser. No. 64,117, filed Aug. 6, 1979, for Split Fountain Blade & Assembly, the disclosure of which is specifically incorporated herein by reference.

Figure 18:
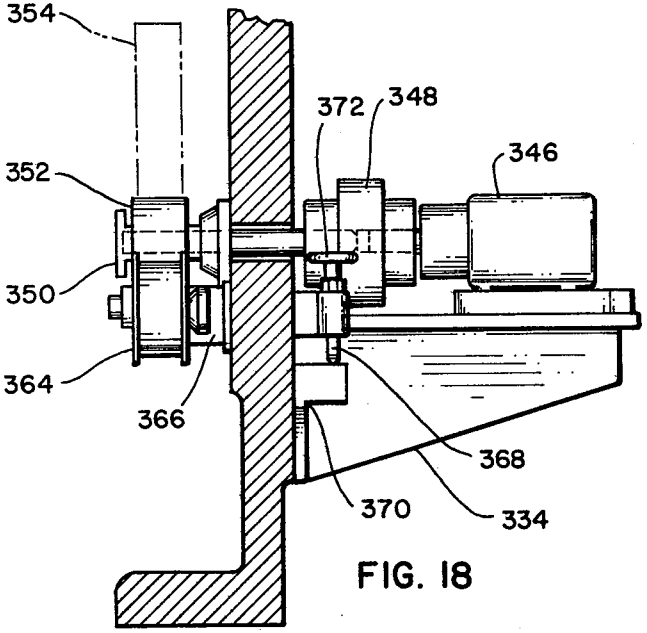
FIG. 18 is another end view of the drive system of FIG. 16.

Referring now to FIGS. 16–19, the drive means 57 comprises a drive sprocket 330 connected to main drive shaft 331 by a coupling 332, a timing belt 334 connected to a sprocket wheel 336 on a shaft 338 supported by bearing blocks 340, 342 on a mounting bracket 344, a gear box 346 connected by a coupling 348, FIG. 18, to a shaft 350 which mounts a sprocket wheel 352, and a timing belt 354 connected to sprocket wheel 74, FIG. 2. The tension in timing belt 334 is controlled by an idler wheel 356, FIG. 17, mounted on an adjustable pivot arm 358 attached to frame member 153 by a bracket 362. Tension in timing belt 354 is controlled by an idler wheel 364, FIG. 19, mounted on an adjustable pivot arm 366 having a threaded adjustment screw 368 which engages an abutment bracket 370 and is operable by a hand wheel 372.

In use, the apparatus is located beneath the mandrel turret 24 and applies a protective coating of lacquer to the newly decorated cans 28 on the moving mandrels. The overcoat unit 20 consists basically of a 20" diameter rubber covered applicator roll means 34, one smaller diameter steel metering roll means 48, pre-spin wheel means 33 and overcoat fountain means 50. Overcoat lacquer is fed into the fountain reservoir 329 by supply pipe 256. The metering roll means 48 rotates in a clockwise direction, FIG. 1, between the side plates 270, 272 which are designed to wipe off excess overcoat from the sides of the metering roll means and return it to the fountain reservoir. The overcoat lacquer is metered by the fountain blade members 298 which can be adjusted by the eight adjusting screws 308. The metered amount of lacquer applied on the metering roll means 48 is applied to the applicator roll means 34 which rotates in a counter-clockwise direction as viewed in FIG. 1. After cans leave the decorating nip of the blanket wheel means 32, the rear portion of the mandrels 28 comes in contact with the rubber pre-spin wheel means 33 which maintains rotation of the cans through the overcoat zone to prevent smearing of the previously applied inks. During the overcoat application the mandrels are cammed so the can travels in an inverted arc around the applicator roll means 34 to ensure sufficient roll contact time to apply a complete overcoat with minimum pressure and applicator wheel speed. During normal operation the overcoat is driven directly from the main drive shaft through a variable speed pulley which allows adjustment of the overcoat unit speed to obtain the correct overlap of overcoat on the can. Adjustment means are also provided for setting applicator roll/can pressure, skew angle, position of the overcoat laydown on the can, and applicator roll/metering roll pressure. The entire overcoat unit is mounted on frame means 36 which is pivotably supported by shaft means 132. When not in use, the overcoat unit may be lowered by an air cylinder means controlled by a manual valve (not shown). The overcoat material is held in a portable supply tank (not shown) and fed to the overcoat unit by an electric metering pump (not shown) with an adjustable feed rate.

The overcoat unit 20 is provided with the following adjustment means:

A. Overcoat Applicator Roller Means Adjustments (1) The longitudinal position of the applicator roller means 34 may be adjusted by push-pull adjustment screw means 380, FIG. 5, which locate the applicator roller means relative to shaft means 98.

(2) The contact pressure between applicator roller means 34 and can 28 may be adjusted by turning shaft means 213, 215, FIG. 8, to actuate jack screw means 196.

(3) The rotational axis of applicator roller means 34 may be maintained parallel to the axes of mandrels 28 by adjustment means 46.

(4) The rotational speed of the applicator roller means may be adjusted by conventional means (not shown) or pre-set in a fixed relationship so that on contact with the applicator roller means 34, the can makes approximately 1 and ¼ revolutions.

B. Overcoat Metering Adjustments (1) The longitudinal position of metering roll means 48 may be adjusted by push-pull adjustment screw means 382, FIG. 5, which locate the meter roll means relative to shaft means 86.

(2) The position of the side walls 270, 272, FIG. 13, of fountain means 50 relative to metering roll means 48 may be adjusted by mounting bolt means 292, FIG. 12; and the position of blade members 298, FIG. 1, relative to meter roll means 48 may be adjusted by bolt means 282, FIG. 12. After proper adjustment, the fountain means is held in place by adjustment screw means 294, FIG. 1, and toggle clamp means 384.

(3) The amount and uniformity of lacquer applied to the metering roll means 48 may be controlled by adjustment screw means 308, FIG. 15.

(4) The location of meter roll means 48 relative to applicator roller means 34 may be incrementally adjusted by adjustment screw means 54, FIG. 1, which causes eccentric sleeve 88, FIG. 5, to rotate in hub portion 72 and thereby change the location of axis 108 relative to axis 110.

The apparatus of the present invention enables reliable usage of inks and lacquer coatings at high operational decorating speeds in excess of 1000 cans per minute while also enabling the use of conventional associated ultraviolet curing systems which require carefully controlled amounts and uniformity of the lacquer overcoat. An important feature of the present invention is the provision of overcoat apparatus which requires only one meter roller means with sufficient adjustment features to maintain required characteristics of the lacquer overcoat on the cans.

Metering roller means 48 is a conventional machine engraved roll of the type manufactured by Consolidated Engravers Corp. of Charlotte, N.C. which has been used heretofore in other applications. It has been determined that for the application of the present invention, a tri-helical pattern or, more preferably a QCH Screen pattern, which is composed of hexagonal cells joined by channels should be used. The cells of the QCH System are engraved on the roll at an angle of 90° to the roll axis to enable constant ink flow from cell to cell which causes an even distribution of ink over the roll surface and onto the applicator roll means.

While a presently preferred and illustrative embodiment of the invention has been described, it is intended that alternative embodiments be included within the scope of the appended claims except insofar as limited by the prior art.

The invention claimed is:

1. Apparatus for decorating cans or the like comprising:

a mandrel wheel means having a plurality of circumferentially spaced rotatable mandrel means for carrying cans in a generally circular path of movement past inking means for applying ink images to the peripheral surfaces of the cans;

an applicator roll means located next adjacent and downstream of said inking means and being engageable with the peripheral surfaces of the cans for applying a coating material over the ink images on the peripheral surfaces of the cans;

a pre-spin wheel means operatively associated with said applicator roll means and being engageable with said rotatable mandrel means before said applicator roll means engages the peripheral surfaces of the cans for causing rotation of said rotatable mandrel means prior to engagement of said applicator roll means with the peripheral surfaces of the cans;

a single engraved meter roll means mounted in juxtaposition to and engaging said applicator roll means for applying a coating material to said applicator roll means;

a fountain means having a reservoir for holding a quantity of the coating material and metering blade means operably associated with said meter roll means for applying a predetermined quantity of coating material to said meter roll means;

drive means operably connected to said applicator roll means and said pre-spin wheel means and said meter roll means for causing synchronized rotation thereof;

a common movable support means for supporting said applicator roll means and said pre-spin wneel means and said meter roll means and said fountain means for movement between an operational position adjacent said mandrel wheel means whereat said applicator roll means engages the peripheral surfaces of the cans and an inoperative position whereat said applicator roll means is spaced from the peripheral surfaces of the cans;

actuating means operably associated with said common movable support means for selectively moving said common movable support means between the operative position and the inoperative position;

an applicator roll pressure adjustment means operably associated with said common movable support means for causing variable movement thereof in the operative position whereby the position and engaging pressure of said applicator roll means relative to the cans is selectively variably adjustable;

a meter roll pressure adjustment means mounted on said common movable support means and being operably associated with said meter roll means for selectively variably adjusting the position and engaging pressure of said meter roll means with said applicator roll means;

fountain adjustment means mounted on said common movable support means and being operably associated with said fountain means for selectively variably adjusting the position of said fountain means relative to said meter roll means to control the amount and distribution of coating material transferred from said fountain means to said meter roll means; and support adjustment means operatively associated with said common movable support means for selectively variably adjusting the axis of rotation of said applicator roll means relative to the axis of rotation of said mandrel means to maintain substantial parallelism therebetween.

2. The invention as defined in claim 1 and wherein said common movable support means further comprising:

a pivotally movable support frame; and a pivotal frame supporting means for said support frame and providing a pivotal axis extending generally parallel to the axes of said mandrel means.

3. The invention as defined in claim 2 and wherein said pivotally movable support frame further comprising:

an L-shape base member having a flat upper support surface;

a housing member having a flat lower surface mounted on the said flat upper support surface of said L-shape base member;

a first mounting means in said housing member for mounting said applicator roll means and said prespin wheel means thereon; and a second mounting means in said housing member for mounting said meter roll means and said fountain means thereon.

4. The invention as defined in claim 3 and further comprising:

a fountain housing means mounted on said second mounting means for enclosing said fountain means.

5. The invention as defined in claim 4 and wherein said fountain housing means further comprising:

a lowermost support plate means for adjustably slidably supporting said fountain means;

side plate means mounted on said lowermost support plate means for defining a chamber in which said fountain means is mounted; and a coating material supply means extending into said chamber for supplying coating material to said fountain means.

6. The invention as defined in claim 3 and wherein:

said meter roll means having a roll support shaft;

said second mounting means comprising a rotatable eccentric sleeve rotatably supporting said roll support shaft; and said meter roll pressure adjustment means comprising jack screw means operably associated with said eccentric sleeve means for causing rotation thereof relative to said housing member to thereby change the position of said meter roll means relative to said applicator roll means.

7. The invention as defined in claim 3 and wherein said pivotal frame supporting means comprising: a shaft member, a univeral joint device supporting one end of said shaft member, and said support adjustment means being operably associated with the other end of said shaft member.

8. The invention as defined in claim 7 and wherein said support adjustment means comprising:

a shaft support device having an opening receiving the other end of said shaft member; and a pair of oppositely mounted adjustment screw devices mounted on said shaft support device and extending into said opening to engage and locate the other end of said shaft member therewithin.

9. The invention as defined in claim 1 and wherein said engraved meter roll means comprises:

a pattern of hexagonal cells joined by channels to enable constant ink flow from cell to cell.

10. The invention as defined in claim 1 and wherein said actuating means operably associated with said common movable support means comprises:

a power cylinder means for selective actuation to move said common movable support means between the operative position and the inoperative position; and linkage means for connecting said power cylinder means to said common movable support means.

11. The invention as defined in claim 1 and wherein said applicator roller adjustment means comprising:

jack screw means for selective actuation to move said common movable support means relative to said mandrel means in the operative position; and linkage means for connecting said jack screw means to said common movable support means.

* * * * *

UNITED STATES PATENT AND TRADEMARK OFFICE

CERTIFICATE OF CORRECTION

PATENT NO. : 4,441,418

DATED : April 10, 1984

INVENTOR(S) : Roger A. Hahn

It is certified that error appears in the above-identified patent and that said Letters Patent are hereby corrected as shown below: Title page:

-- James S. Stirbis, Littleton, Colo. -- should have been entered as a co-inventor.

Signed and Sealed this

*Thirteenth* Day of *November 1984*

[SEAL]

*Attest:*

GERALD J. MOSSINGHOFF

*Attesting Officer*

*Commissioner of Patents and Trademarks*